US005232375A

United States Patent [19]

Todd

[11] Patent Number: 5,232,375

[45] Date of Patent: Aug. 3, 1993

[54] PARALLEL LATCHING DEVICE FOR CONNECTORS

[75] Inventor: Christian A. Todd, Thornton, Colo.

[73] Assignee: Storage Technology Corporation, Louisville, Colo.

[21] Appl. No.: 965,449

[22] Filed: Oct. 23, 1992

[51] Int. Cl.[5] ..... H01R 13/62

[52] U.S. Cl. ..... 439/157; 439/160

[58] Field of Search ..... 439/372, 152, 153, 157, 439/159, 160

[56] References Cited

U.S. PATENT DOCUMENTS

| | | | |
|---|---|---|---|
| 2,794,961 | 6/1957 | Knight | 439/372 |
| 4,026,624 | 5/1977 | Boag | 339/91 R |
| 4,273,403 | 6/1981 | Cairns | 339/91 R |
| 4,462,654 | 7/1984 | Aiello | 339/91 R |
| 4,941,849 | 7/1990 | Fujiura | 439/610 |
| 5,002,496 | 3/1991 | Fox, Jr. | 439/197 |
| 5,135,408 | 8/1992 | Suzuki | 439/372 |
| 5,135,410 | 8/1992 | Kawase et al. | 439/372 |
| 5,174,785 | 12/1992 | Endo et al. | 439/372 |

FOREIGN PATENT DOCUMENTS

| | | | |
|---|---|---|---|
| 0056875 | 2/1990 | Japan | 439/372 |
| 0278674 | 11/1990 | Japan | 439/372 |
| 0453456 | 6/1968 | Switzerland | 439/377 |

*Primary Examiner*—David L. Pirlot

*Attorney, Agent, or Firm*—Sterne, Kessler, Goldstein & Fox

[57] ABSTRACT

A latching device for connecting two mating components in a parallel fashion. The latching device includes a connector mount attached to one mating component and a lock and eject catch member attached to the other. Two cams are rotatably attached to the connector mount which accept a respective catch pin located on the lock and eject catch member. Each cam has a cam access slot and a cam channel configured receive the associated catch pin and enable it to travel along the cam channel as the cam is rotated. The two cams are securely connected by torsion bar extending through a channel in the connector mount. The torsion bar transfers the rotational force applied to one cam to the other and converts the rotational force applied to the cams to a linear force applied to the connector mount and lock and eject catch member. The latching device also has a guide member connected to the connector mount and a guide receiving channel in the lock and eject catch which is configured to receive the guide member. The connector mount and the lock and eject catch each have a mating contact surface which are configured to contact each other and prevent the latching device from engaging further. The latching device also includes a wave spring which increases the rotational friction of the cams to prevent unassisted rotation and a rotating knob to assist the user in rotating the cams.

14 Claims, 12 Drawing Sheets 100
101
102
104
106
108
110
112
114
116
118
120
121
122
124
126
128
130
132
134
136
137
138
140
142
144
146
148
150
152
154
156
158
160
I

PARALLEL LATCHING DEVICE FOR CONNECTORS

BACKGROUND OF THE INVENTION

1. Field of the Invention

The present invention relates generally to connectors, and more particularly, to latching devices for electrical connectors.

2. Related Art

The use of electrical connectors is common and well known. Electrical connectors generally comprise nonconductive housings in which one or more electrically conductive terminals are mounted. The terminals are mechanically and electrically joined to conductive leads, such as wires, cables or conductive areas on a circuit board. The type of terminals used in electrical connectors takes on many forms, such as pairs of pins and sockets. Electrical connectors are employed in mateable pairs, wherein the respective housings and terminals in a pair of electrical connectors are mateable with one another. Thus, for example, a pair of electrical connectors may be used to electrically connect the conductors of a cable and the printed circuits on a printed circuit (PC) board, or the conductors of two cables, or the printed circuits of two PC boards.

Electrical connectors may include some type of latching means for securely but releasably retaining the pair of electrical connector housings in a mated condition. Various requirements are found in electrical connection systems for retaining housing parts together.

Conventional techniques to securely but releasably retain a pair of electrical connectors in a mated condition include the use of screws, latching arms, molded plastic housings, spring arms, and over-center latching mechanisms, to name a few. These conventional latching techniques generally work well in securing the two mating components together. However, as will be discussed below, these conventional approaches do not sufficiently prevent unparallel mating of the connector housings. Secondly, they do not prevent damage from occurring to the cables, PC boards, or pins in high insertion force applications, nor do they prevent overstressing due to either twisting or overcompression of the connector housings. Thirdly, they do not prevent the partial mating of connectors. Finally, some conventional latching means only provide a means for engaging, not disengaging, the two connector housings.

In addition to these specific operational drawbacks, many of the conventional latching techniques can only be used with only a single application, i.e., PC board to PC board, cable to cable, or cable to PC board. These and other drawbacks of conventional latching techniques are described below.

The improper installation of electrical connectors has long be a problem in assemblies containing interconnected electrical circuits. Even though the specific electrical connector can perform adequately under normal circumstances, open circuit conditions can occur when electrical connectors are not properly mated.

In addition to open circuits, which result from improper installation, terminal and connector retention are also important due to potential problems encountered over the life of the particular device. For example, excessive vibration over time can cause one connector to disengage from its associated connector. Furthermore, improper retention of contact terminals and connectors can result in unstable electrical interfaces which can result in corrosion, thus leading to a gradual deterioration of the electrical interconnection.

Many electrical connectors are used in environments where they will be repeatedly connected and disconnected by field technicians and other personnel. Some of these users have relatively little familiarity with the mechanics or intended use of the connector. It is not uncommon for field technicians to have inadequate training on the proper usage of every electrical connector they are likely to encounter. This lack of familiarity with the electrical connectors can result in overstressing the latch mechanisms employed to lockingly but releasably retain electrical connector housings in a mated condition. It is not uncommon, for example, to have inexperienced field personnel to unintentionally bias a latch mechanism too far, thereby breaking or reducing the effectiveness of the latch.

One conventional technique which has been employed in latching mechanisms to minimize this potential for overstressing the connector housing and latching mechanism has been the utilization of a latching arm. For example, U.S. Pat. No. 4,462,654 to Aeillo shows a latch mechanism integrally and pivotally connected to an electrical housing. The forward end of the latch extends from the pivoted connection to define a latch portion which is engageable with a corresponding structure on the associated mateable housing. The rearward end of the latch member extends in the opposite direction from the pivot and includes an overstress stop which is pivotable into a lug or wall on the electrical connector housing. Contact between the overstress stop and the lug or wall of the electrical connector housing is intended to limit the amount of rotation around the pivot point during the normal engagement of the electrical connector housings. This approach controls the amount of pivoting during proper use of the electrical connector. However, it does not provide positive antistress protection adjacent to the forward end of the latch member. Thus, inexperienced field personnel may apply rotational pressure to the forward most end of the latches for either locking or releasing the electrical housings to one another. Such rotational forces exerted on the forward end of the latch member may overstress the latch, thereby causing the latch to break or be of reduced effectiveness.

Another problem with the conventional latching techniques for electrical connectors is their inability to prevent unparallel mating of the connector housings. For example, some conventional techniques utilize screws as a means for maintaining the connectors in engagement to prevent separation due to excessive vibration. These screw-type latching mechanisms are configured to be adjusted either by hand or by tool. Although these techniques securely hold the two mateable electrical connector housings together, they do not prevent the connectors from being mated or separated in an unparallel fashion. In addition, in order to latch or unlatch the mating components, one has to rotate the screw through numerous revolutions in order to completely separate the two connector housings.

Many applications require the mateable terminals and associated electrical connectors to be specifically designed to achieve substantial contact forces against one another in their fully mated condition. These necessary contact forces can result in significant insertion forces during mating and unmating, particularly as the number of terminals in a connector increases. These high insertion forces may potentially damage the surface mount components or printed circuits if one or both of the mating components is a PC board. High insertion forces may also cause damage to the terminals of a cable connector.

The existence of high insertion forces also creates the possibility that the person who mates the electrical connectors will not be completely mated. Incomplete insertion of mated connectors typically will yield less than specified contact forces between the mated terminals and can result in poor electrical performance or unintended separation of the partly mated connectors. This may result in problems similar to those discussed above in relation to electrical connectors having poor connector retention.

To help insure complete insertion and to prevent unintended separation of mateable connectors, many electrical connector housings are provided with interengageable locks. In particular, one connector may comprise a deflectable latch while the opposing mateable connector may comprise a locking structure for engagement by the latch. Most conventional connectors with deflectable latches and corresponding locking structures can lockingly retain connectors in their mated condition, but require complex manipulation to achieve mating or unmating. The above-described high insertion forces in combination with the manipulation required for the locking means in conventional connectors can make mating and unmating particularly difficult.

Some conventional approaches include ramped locking structures which are intended to assist in the complete insertion of the connectors. In particular, many conventional approaches include connectors wherein a deflectable latch on one connector and a corresponding locking structure on the mateable connector are constructed such that the resiliency of the latches and the angular alignment of the ramp cooperate to urge the connectors toward a fully mated condition. Examples of electrical connectors with this general construction are shown in U.S. Pat. No. 4,026,624 to Boag and U.S. Pat. No. 4,273,403 to Cairns. In these connectors, the unmating is rendered difficult by the need to overcome both, the contact forces in the terminals and the ramping forces in the latches of the housing. Therefore, although these latches facilitate the mating of the connectors, they require substantially greater forces in unmating. As a result, two hands are required. Also, these greater forces sometimes cause the user to pull at the cables rather than the connector housings and latches.

A similar type of conventional connector includes the use of a spring-arm instead of a ramped locking structure mentioned above. For example, U.S. Pat. No. 4,941,849 shows a shielded electrical connector having a latching mechanism comprising an outer insulating cover which is profiled to overlap and encompass an inner shielded connector sub-assembly. The outer housing of the electrical connector has a pair of spring-arms hinged to it which are spring loaded into a position where the forward section of the spring-arm is proximate to the side walls of the shielded sub-assembly. The forward section of the spring-arm includes a rearwardly directed latching face, which is latchable to a complementary latching structure and a complementary connector. The outer insulating housing member includes windows along the sidewalls such that when the outer housing overlaps the inner shielded sub-assembly, actuator arms of the inner spring members extend outwardly through the windows of the outer housing members.

To unlatch the connectors, the spring-arms are compressed toward the shielded inner sub-assembly causing the spring-arms to rotate about their hinged position thereby moving the forward section, including the rearwardly facing latch, outwardly to a position where the connector assembly is adequate for its intended purpose. A disadvantage of this connector design is that two separate movements must be made prior to unlatching the connector. The latching arms must be compressed and the connector housings must be pulled rearwardly to unlatch the connector assembly.

Another problem of conventional electrical connectors is referred to in the art as "fish-hooking." In particular, the latch members on many electrical connectors are cantilevered structures that effectively function as fishhooks which may catch insulated leads as the electrical connector is being inserted into or removed form an electrical apparatus. Fish-hooking can damage an adjacent circuit that is unintentionally caught by the latch structure of the electrical connector housing. Additionally, an attempt to latch or unlatch structure while a wire or other lead is in its fish-hooked engagement can permanently damage the electronic device.

Often, electrical connectors and their latching means are constructed as a single integral unit. The housing and latch structures are commonly molded from the same plastic material. However, all plastics will eventually be deformed or yield their shape when submitted to a continuous load. This is particularly true for nylon, which loses its resiliency over time or temperature. Accordingly, conventional latching mechanisms made of plastics lose their effectiveness over time for assisting in the continued retention of the connector housings.

What is needed is a latching device that can be used with multiple configuration, e.g., PC board to PC board, PC board to cable, and cable to cable. These latching devices must be able to latch and unlatch connectors in a parallel fashion and remove or absorb the high-linear insertion force required in some applications. In addition, the latching devices must be able to protect the electrical terminals and printed circuits of the mating devices by preventing overstressing, either by twisting or overcompression. Also, what is needed is a parallel latching device which will provide the user some indication or provide some guarantee that the connector housings are in their fully mated position.

SUMMARY OF THE INVENTION

A latching device for connecting two mating components in a parallel fashion. The latching device includes a connector mount configured to be attached to one mating component and a lock and eject catch member configured to be attached to the other mating component. The lock and eject catch member includes two catch pins connected to and extending from the lock and eject catch member on opposite sides. The connector mount has two cams rotatably connected to it. Each cam has a cam access slot and a cam channel configured to receive the associated catch pin and enable it to travel along the cam channel as the cam is rotated.

The two cams are securely connected to each end of a torsion bar which extends through a torsion bar channel from one side of the connector mount to the other. The torsion bar transfers the rotational force applied to one cam to the other and converts the rotational force applied to the cams to a linear force applied to the connector mount and lock and eject catch member.

The latching device also has a guide member connected to the connector mount and a guide receiving channel in the lock and eject catch which is configured to receive the guide member. When the guide member and the guide receiving channel are aligned, the catch pins are also aligned with their respective cam access slots. The connector mount and the lock and eject catch each have a mating contact surface which are configured to contact each other and prevent further rotation of either cam to cause the latching device to engage further. This will prevent damage from overcompression from occurring to the mating components.

The latching device also includes a wave spring which increases the rotational friction of the cams to prevent unassisted rotation. The cams also include a rotating knob to assist the user in rotating the cams.

The latching device is used to mate multiple electrical connectors. These electrical connectors are attached to the same support member as the connector mount and the lock and eject member. The latching device prevents the electrical connectors from being damaged by overcompression, twisting, etc., and prevents the associated components such as a PC board or cable for being damaged in high insertion force applications.

Further features and advantages of the present invention, as well as the structure and operation of various embodiments of the present invention, are described in detail below with reference to the accompanying drawings. In the drawings, like reference numbers indicate identical or functionally similar elements. Additionally, the left-most digit of a reference number identifies the drawing in which the reference first appears.

BRIEF DESCRIPTION OF THE DRAWINGS

The present invention will be described with reference to the accompanying drawings, wherein.

DETAILED DESCRIPTION OF THE PREFERRED EMBODIMENTS

1. Parallel Latching Device Structure

Figures 1A, 1B:
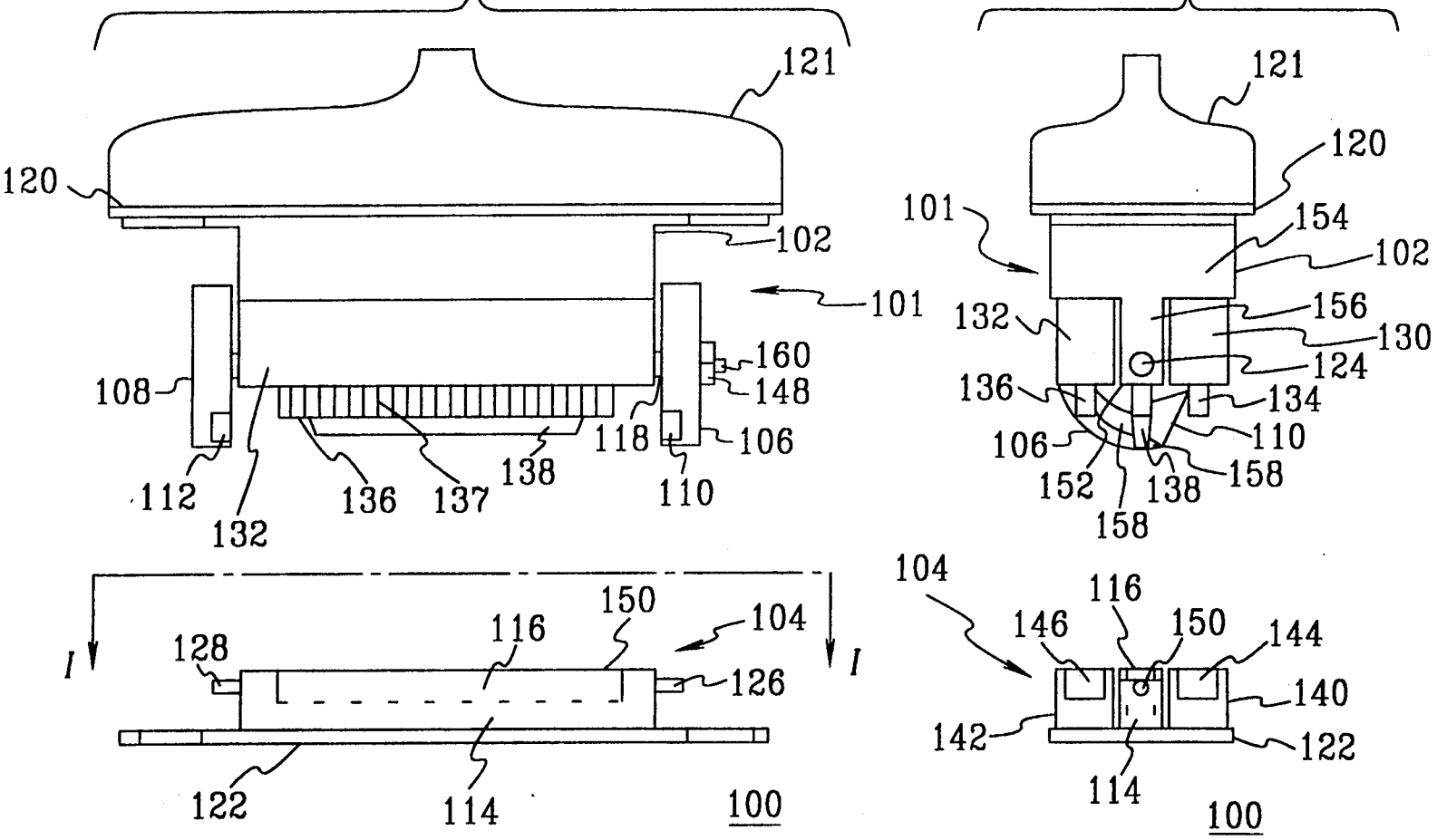
FIG. 1A is a front orthogonal view of the preferred embodiment of parallel latching device 100 of the present invention in its unlatched and separated position.
FIG. 1B is a side orthogonal view of the parallel latching device 100 in its unlatched and separated position with the front lock and eject cam omitted for clarity.

Referring to FIGS. 1A and 1B, a front and a side orthogonal view of parallel latching device 100 is presented. Parallel latching device 100 is attached to and serves to lockingly but releasably retain first mating components 120 with second mating component 122. In the preferred embodiment of the present invention, first mating component 120 is the tension relief member for cable 121. The tension relief member (first mating component 120) is securely fastened to each wire within cable 121. Second mating component 122 is a printed circuit (PC) board. However, as will be readily apparent to those of ordinary skill in the art, mating components 120 and 122 may be any combination of printed circuit (PC) board or cable. In addition, mating components 120 and 122 may also be any pair of non-electrical devices which need to be secured together.

Parallel latching device 100 is composed of a top section 101 and a bottom section 104. As illustrated in FIGS. 1A and 1B, the top section 101 of parallel latching device 100 is mechanically connected to first mating component 120. Similarly, bottom section 104 of parallel latching device 100 is mechanically connected to second mating component 122.

Also, attached to mating components 120 and 122 are the electrical connectors which need to be mated in order to form the desired electrical connection. These electrical connectors are generally comprised of non-conductive housings and contain one or more electrically conductive terminals. The electrical connectors are employed in mateable pairs, wherein the respective housings and terminals in one pair are mateable with the housings and terminals of its associated connector. In the preferred embodiment of the present invention, parallel latching device 100 is utilized to lockingly and releasably connect two pairs of mateable connectors. Referring to FIG. 1B, there is a first male connector housing 130 and a second male connector housing 132. There is also the associated first female connector housing 140 and second female connector housing 142. The first male connector housing 130 and second male connector housing 132 are electrically and mechanically connected to the first mating component 120. Similarly, the first female connector housing 140 and second female connector housing 142 are electrically and mechanically connected to second mating component 122. However, the number of connectors which are used in conjunction with parallel latching device 100 is not critical to the present invention, i.e., parallel latching device 100 may be used with any number and type of connectors. Also, the configuration of the connectors is not limited by the parallel latching device 100. For example, the electrical connectors can be of any type, shape, or contain any number of terminals which is appropriate for a particular application.

The first male mating component 130 is comprised of raised terminal 134 and the second male component 132 is comprised of raised terminal 136. Each of the raised terminals 134 and 136 includes a plurality of electrical contacts 137. The first female connector 140 is comprised of receiving terminal 144 and the second female connector 142 is comprised receiving terminal 146. Each of the receiving terminals also includes a plurality of electrical contacts (not shown). The terminals of the terminal pair 134/144 are configured to work in conjunction with each other to form an electrical connection between their respective electrical contacts when parallel latching device 100 is in its latched and secured position. Likewise, the terminals of the terminal pair 136/146 are also configured to form an electrical connection between their respective electrical contacts when parallel latching device 100 is in the latched and secured position. In a preferred embodiment to the present invention, the terminal pairs 134/144 and 136/146 are of the same type and size. However, as will be readily apparent to those of ordinary skill in the art, these terminal pairs may be any type of terminal pair available, and are not required to be the same.

The electrical contacts of terminals 134, 136, 144, and 146 are mechanically and electrically connected to the conductive leads of mating components 120 and 122. These conductive leads may be wires, cables, or conductive areas, depending on the type of mating components used in a given application. For example, in the preferred embodiment of the present invention, the conductive leads which are used to connect male connector housings 130 and 132 with the first mating component 120, are wires since the first mating component 120 is a cable. On the other hand, the conductive leads which are used to connect female connector housings 140 and 142 with the second mating component 122 are conductive areas since the second mating component 122 is a PC board.

Connector mount 102 is that part of the top section 101 which comes into contact with, and is secured to, first mating component 120. Connector mount 102 may be secured to first mating component 120 in any manner which meets the force, space, and loading requirements of a particular application. For example, in the preferred embodiment of the present invention, connector mount 102 is comprised of a connector mount base 154 which is wider than connector mount body 156. This wide connector mount base 154 includes fastening holes 302 and 304. Fastening holes 302 and 304 are provided to enable connector mount 102 to be secured to first mating component 120 with two screws.

Figure 3B:
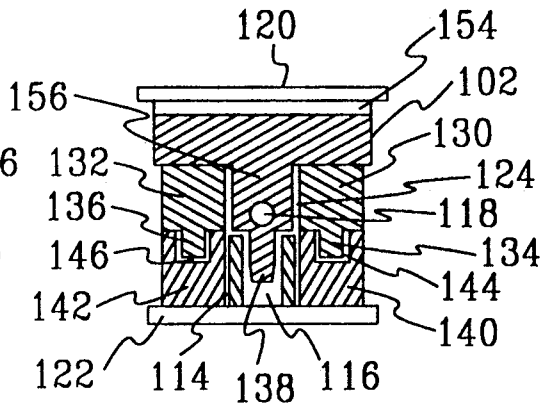
FIG. 3B is a cross-section view of parallel latching device 100 taken along plane III—III of FIG. 2A.

Referring to FIGS. 1B and 3B, connector mount 102 has also been located between male connector housings 130 and 132 and first mating component 120. In this configuration, connector mount 102 has become an integral part of first mating component 120. Forces which are applied at connector mount 102 are distributed across the wide connector mount base 154 and transferred to first mating component 120 by the screws used to secure connector mount 102 to first mating component 120 through fastening holes 302 and 304.

Included in the top section 101 of parallel latching device 100 are a torsion bar 118 and lock and eject cams 106 and 108. Connector mount 102 is comprised of a torsion bar channel 124 configured to accept torsion bar 118. Torsion bar channel 124 is configured to enable the torsion bar 118 to rotate freely within connector mount 102. Referring to the exploded view of parallel latching device 100 in FIG. 6, in a preferred embodiment, the torsion bar channel 124 is not fully enclosed. Torsion bar channel 124 is open on one side of connector mount body 156 to simplify the manufacturing process.

Figure 6:
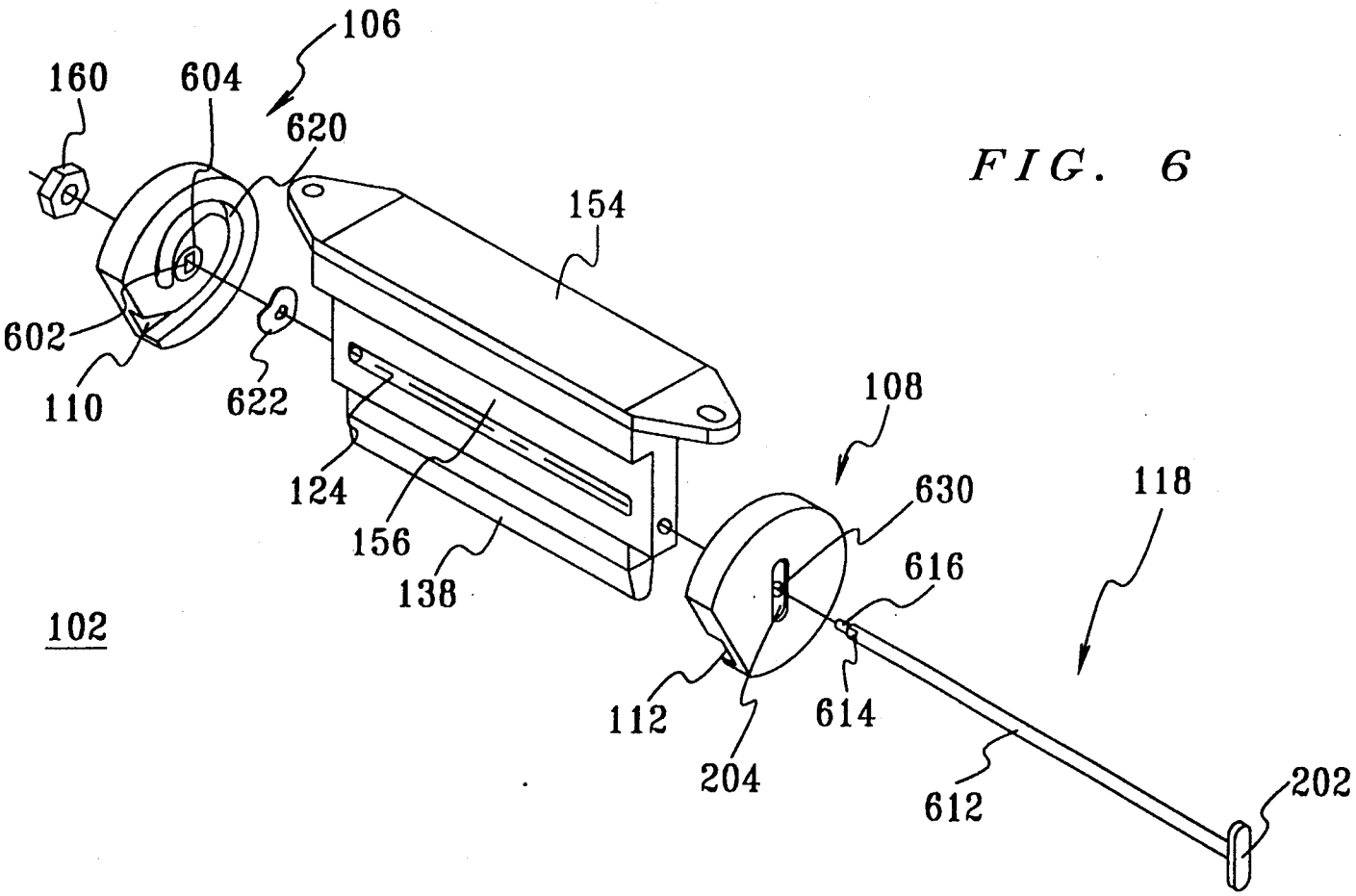
FIG. 6 is an exploded isometric view of top section 101 of parallel latching device 100.

Torsion bar 118 is configured to securely attach to and align lock and eject cams 106 and 108 to prevent slippage and to completely and evenly distribute the rotational forces applied to one or both lock and eject cams 106 and 108. One method used to secure lock and eject cams 106 and 108 to torsion bar 118 is illustrated in FIG. 6. Lock and eject cam 108 includes a locking inset 204 and a torsion bar access hole 630. Similarly, lock and eject cam 106 contains a locking inset (not shown) and a torsion bar access hole 602. Locking inset 204 is configured to securely accept the flared head 202 of torsion bar 118. When torsion bar 118 is fully inserted into lock and eject cam 108, the flared head 202 is securely seated within locking inset 204. The torsion bar shaft 612 of torsion bar 118 passes through the torsion bar channel 124 of connector mount 102. The torsion bar access hole 602 of lock and eject cam 106 is comprised of a keying means 604 to securely align torsion bar 118 and lock and eject cam 106 together. In addition, the lock and eject cam slots 110 and 112 are guaranteed to be in alignment. When lock and eject cam 106 is attached to torsion bar 118, the locking surface 614 of the torsion bar 118 rests within the torsion bar access hole 602 and is securely held in place by keying means 604. In its fully assembled configuration, the threaded region 616 of torsion bar 118 extends past the surface of the lock and eject cam 106 to accept nut 160.

In the present invention, torsion bar 118 is designed in conjunction with the lock and eject cams 106 and 108. The structure of torsion bar 118 with its flanged head 202 and threaded region 616 are the means provided in the preferred embodiment to secure the lock and eject cams 104 and 106 to torsion bar 118. However, as will be apparent to one of ordinary skill in the art, lock and eject cams 104 and 106 may be secured to torsion bar 118 in any manner necessary to meet the loading and alignment requirements that will be placed upon the parallel latching device 100. For example, the lock and eject cams 106 and 108 may be "snap fit" onto torsion bar 118.

Connector mount 102 is also comprised of a connector guide 138. As illustrated in FIG. 1B, connector guide 138 extends below the terminals 134 and 136 of male connector housings 130 and 132. Connector guide 138 assists in the initial alignment of the top section 101 of parallel latching device 100 with the bottom section 104. This will be further discussed below in reference to the bottom section 104.

Referring to FIG. 1A, the lock and eject cam 106 is comprised of a cam rotating knob 148. The purpose of the cam rotating knob 148 is to provide the user with a means to rotate lock and eject cams 106 and 108. In the preferred embodiment of the present invention, cam rotating knob 148 is configured to allow the user to rotate the lock and eject cams 106 and 108 with two fingers. However, one should note that the cam rotating knob 148 may be configured such that the latching operation may be performed by hand or with a tool. For example, lock and eject cam 106 may be comprised of a cam rotating knob 148 which is a raised hexagonal surface adapted to be accepted by a wrench. In addition, cam rotating knob 148 may be configured to accept only a specially configured tool in order to prevent tampering with the parallel latching device 100. It should also be noted that though the preferred embodiment of the present invention provides a single control means (148) attached only to lock and eject cam 106, the control means may be left out or an additional or alternative control means may be included on lock and eject cam 108.

Figure 3A:
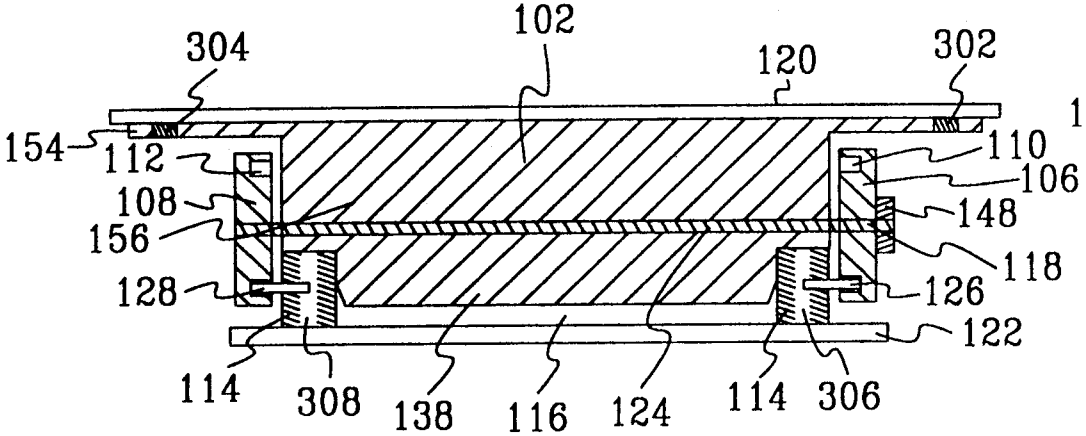
FIG. 3A is a cross-sectional view of parallel latching device 100 taken along plane II—II of FIG. 2B.

The bottom section 104 of parallel latching device 100 includes a lock and eject catch 114 and catch pins 126 and 128. Referring to FIGS. 1B, 3A and 3B, lock and eject catch 114 is secured to second mating component 122 and is positioned among female connector housings 140 and 142. Lock and eject catch 114 may be secured to second mating component 122 in the same or different manner as connector mount 102 is secured to first mating component 120. Lock and eject catch 114 includes two fastening holes 306 and 308. Fastening holes 306 and 308 provide means by which lock and eject catch 114 is secured to second mating component 122. In the preferred embodiment of the present invention, lock and eject catch 114 is secured to the second mating component 122 with screws. However, as will be readily apparent to those of ordinary skill in the art, lock and eject catch 114 may be secured to the second mating component 122 by any other available means. For example, lock and eject catch 114 may be secured to the second mating component 122 with an adhesive. In addition, the present invention may include a lock and eject catch 114 configured with a wide base similar to the connector mount base 154. The method and configuration used to secure lock and eject catch 114 is dependent upon the load and forces under which the parallel latching device will operate in a particular application of the present invention.

Lock and eject catch 114 also includes a guide receiving channel 116 which is configured to accept the connector guide 138 of connector mount 102. As described above, connector guide 138 extends below terminals 134 and 136 of male connector housings 130 and 132. As a result during latching connector guide 138 contacts guide receiving channel 116 prior to the terminals or connector housings contacting each other. This preliminary guidance ensures that the male connector housings 130 and 132 are properly aligned with the female connector housings 140 and 142 prior to contact with each other. In the preferred embodiment of the present invention, guide member 128 and guide releasing channel 116 are rectangular in shape. However, one should know that any configuration of guide member 138 and guide receiving channel 116 may be used. Such as a circular post and shaft.

Figure 4:
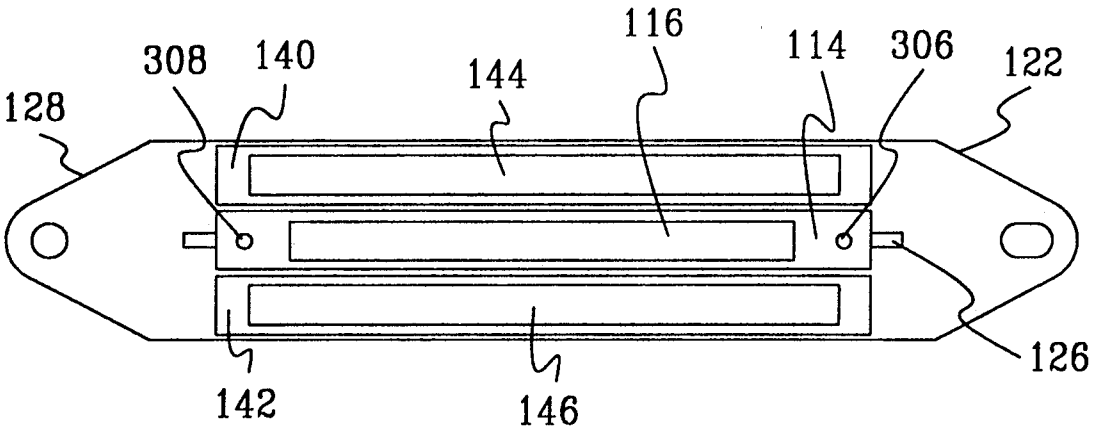
FIG. 4 is a top orthogonal view of the latch and eject catch component 110 mounted to mating component 122, taken along plane I—I of FIG. 1A.
Figure 5:
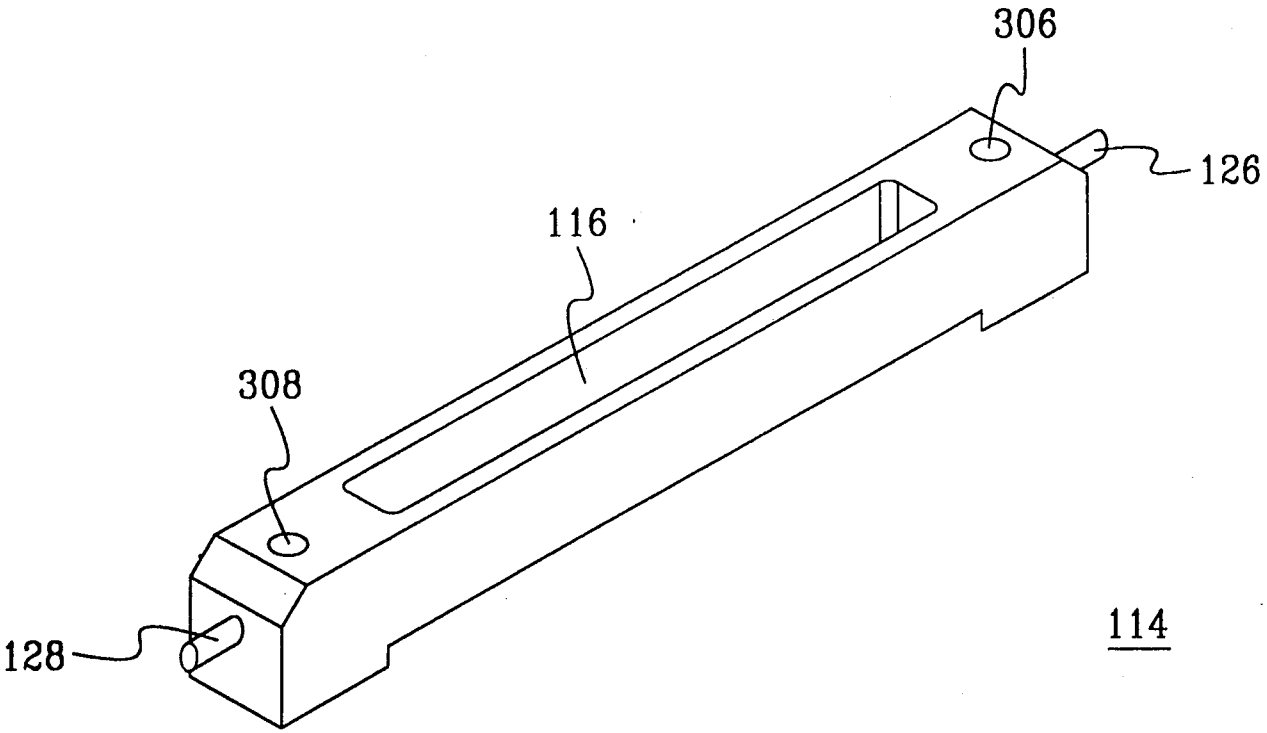
FIG. 5 is a perspective view of the lock and eject catch 114.

Referring to FIGS. 1A and 4, bottom section 104 also includes catch pins 126 and 128. Catch pins 126 and 128 extend from the side surfaces of lock and eject catch 114 and are aligned with the lock and eject cam slots 110 and 112, respectively. Lock and eject cam slots 110 and 112 provide access to the lock and eject cam channels. In the preferred embodiment of the present invention, catch pins 122 and 124 are rigid extension members made of the same material as the lock and eject catch 114. However, one should note that catch pins 122 and 124 may take other forms in the present invention, depending on the forces specified by the particular application.

Figure 2B:
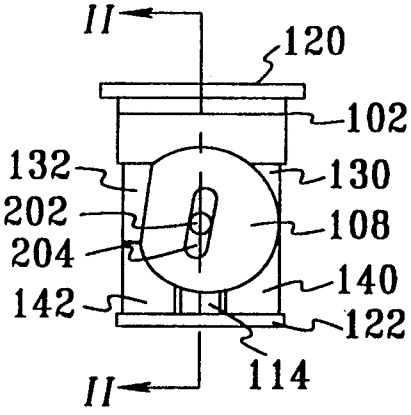
FIG. 2B is a side orthogonal view of the parallel latching device 100 in its latched and secured position.
Figure 2A:
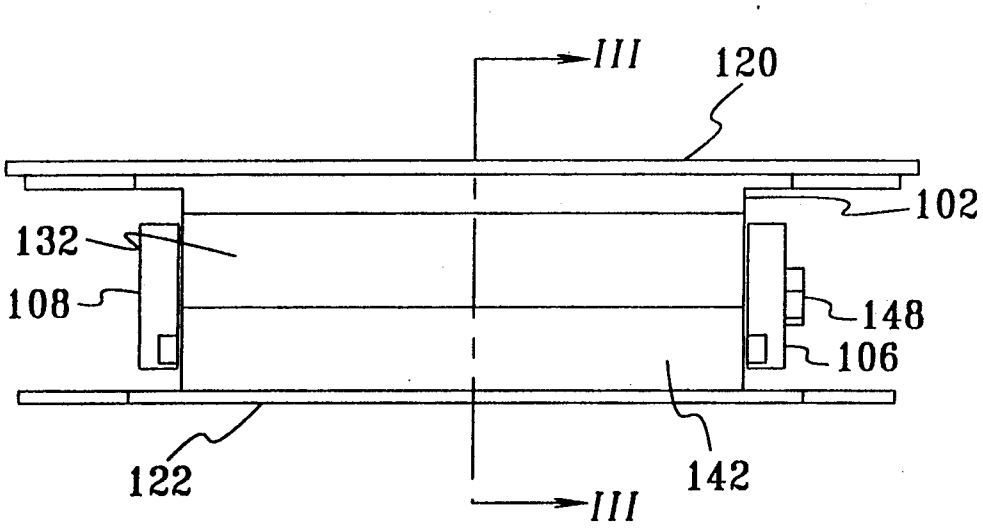
FIG. 2A is a front orthogonal view of the parallel latching device 100 in its latched and secured position.

Referring to FIGS. 2A and 2B, the front and side orthogonal views of parallel latching device 100 in the latched and secured position are illustrated. When the parallel latching device 100 is in its fully latched position, the male connector housings 130 and 132 are completely engaged with the corresponding female connector housings 140 and 142. Referring to the cross-sectional views of parallel latching device 100 in the same position in FIGS. 3A and 3B, one can better see how the components of the top section 101 interact with those of the bottom section 104. FIG. 3A is taken along plane II—II of FIG. 2B, and FIG. 3B is taken along plane III—III of FIG. 2A.

FIGS. 3A and 3B also illustrate how parallel latching device 100 protects the connector housing and terminals from overcompression. Connector mount mating surface 152 and the lock and eject catch mating surface 150 are flush and in contact with each other. The contact area over which these two surfaces contact is the area over which any compression which is placed upon mating components 120 and 122 is distributed. As can be seen in FIG. 3B, in their fully connected position, the terminals 134 and 136 are not contacting the bottoms of receiving terminals 144 and 146.

FIG. 3A illustrates the position of connector guide 138 when parallel latching device 100 is in its fully latched position. Connector guide 138 extends down into the guide receiving channel 116. However, guide receiving channel 116 configured to provide additional space below the connector guide 138 when connector guide 138 is fully inserted. This is to prevent the connector guide 138 from contacting the second mating components 122. This arrangement avoids damage to the second mating component 122 as well as the first mating component 120 and their associated connectors and terminals.

In the fully latched position, the connector guide 138 is fully inserted into the guide receiving channel 116. Any forces which are applied to separate the parallel latching device 100, is absorbed by the latch pins 126 and 128 which are secured in the lock and eject cams 106 and 108. This force is distributed among the components of parallel latching device 100 and is thereby prevented from damaging the electrical contacts of terminals 134 and 136 and receiving terminals 144 and 146 respectively. In addition, when the parallel latching device 100 is in this position, the electrical connectors cannot be twisted relative to each other nor can the top section 101 and the bottom section 104 be compressed against each other in such a manner as to damage the terminals or connectors. In essence, the male connector housings 130 and 132, female connector housings 140 and 142, and their associated terminals contained therein are fully protected by parallel latching device 100.

The insertion force which is necessary to mate male connector housings 130 and 132 with female connector housings 140 and 142, is typically applied as a compression force against first and second mating components 120 and 122 which transfer the force to the connectors. However, in the present invention, the linear insertion force required to mate the connector housings is applied as a low torque rotary motion applied to the cam rotating knob 148. This low torque rotary motion substantially reduces the amount of force which is applied to first and second mating components 120 and 122. In addition, the direction of the force applied to the first and second mating components 120 and 122 has changed. Instead of being a compressive force against the mating components 120 and 122, it is a tensile force experienced at the point of connection between the parallel latching device 100 and the mating components. The low torque rotary motion applied to cam rotating knob 148 is transformed via cam channels 158 and latch pins 126 and 128 into a linear force which is transmitted evenly to male connector housings 130 and 132 and female connector housings 140 and 142.

In certain applications, the user is unable to completely rotate the lock and eject cams 106 and 108 in a single continuous movement. As a result, the user has to release control of lock and eject cams 106 and 108, change hand or tool position, and reacquire control. During such time that the user is not in control of the lock and eject cams 106 and 108, and the parallel latching device is not sufficiently engaged, the lock and eject cams 106 and 108 may rotate in a clockwise position under a tensile force which may be pulling the top section 102 from the bottom section 104. The lock and eject cams 106 and 108 will continue to rotate freely in a clockwise position until catch pins 126 and 128 are released from the lock and eject cam channels. To avoid such an occurrence, the preferred embodiment of the present invention utilizes a cam spring 622 as shown in FIG. 6. Cam spring 622 adds friction to the rotation of torsion bar 118. This prevents the unassisted rotation of lock and eject cams 106 and 108 when the application of rotational force has been removed. The degree of friction which is provided by cam spring 622 will depend on the amount of force that it is designed to overcome. In the preferred embodiment of the present invention, cam spring 622 is a wave spring and surrounds torsion bar 118. However, as would be readily apparent to those of ordinary skill in the art, alternative methods may be used to increase the rotational friction of lock and eject cams 106 and 108.

In the preferred embodiment of the present invention, cam spring 622 works in conjunction with lock and eject cam 106. However, cam spring 622 can alternatively be located on the opposite side of connector mount 102 and work in conjunction with lock and eject cam 108. Cam spring 622 is used in conjunction with lock and eject cam 106 to provide the user with direct feedback of the response of cam spring 622 as the lock and eject cams 106 and 108 are rotated. This enables the user to determine how much force is required to operate parallel latching device 100.

In the preferred embodiment of the present invention, the lock and eject cams 106 and 108 are made of polycarbonate and the torsion bar 118 is made of stainless steel. In addition, the connector mount 102, lock and eject catch 114, and catch pins 126 and 128 are made of aluminum. However, it should be noted that the materials used must be determined by the specific load requirements of each unique application. For example, parallel latching device 100 may be used to connect high voltage power lines. In such an application, the stainless steel torsion bar 118 of the preferred embodiment may have to be replaced by a torsion bar made of a stronger material which can withstand the amount of torque which would be necessary to mate the male connector housings 130 and 132 with the female connector housings 140 and 142. In addition, the aluminum lock and eject catch 110 and catch pins 112 of the preferred embodiment may have to be made out of a stronger material which can withstand the high forces which would be applied to catch pins 126 and 128 in such an application. In addition, cam rotating knob 124 of the preferred embodiment may have to be replaced with a control means which can be used with some type of tool, since such an application would not be conducive to mating the connectors by hand.

2. Parallel Latching Device Operation

The operation of the parallel latching device 100 will now be discussed with reference to FIGS. 7A–7D. For clarity, FIGS. 7A–7D illustrate the operation of only lock and eject cam 106 with catch pin 126. However, lock and eject cam 108 and catch pin 128 operate in a parallel manner. For clarity, lock and eject cam 106 is illustrated with its associated lock and eject cam channel 158 on front of the connector mount 102. In addition, the torsion bar 118, the flanged head 610, cam rotating knob 148, and nut 618 are omitted.

Figure 7A:
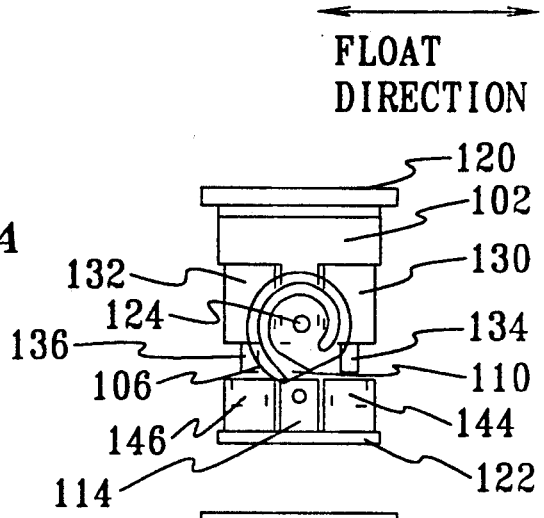
FIG. 7A is a side orthogonal view of parallel latching device 100 in the separated and unlatched position.

FIG. 7A illustrates the parallel latching device 100 in its disengaged position. The disengaged position is defined as that condition wherein terminals 134 and 136 are separated from receiving terminals 144 and 146. In this position, lock and eject cam 106 are held in their stationary position by cam spring 622. In this position, lock and eject cam slot 110 is facing the lock and eject catch 114.

When the parallel latching device 100 is used in an application which contains multiple connectors such as in the preferred embodiment, there must be a degree of lateral movement available to enable the male connector housings 130 and 132 to float (have a minor amount of freedom of movement) relative to the female connector housings 140 and 142. In the preferred embodiment of the present invention, male connector housings 130 and 132 are not fixedly attached to connector mount 102. They are provided limited freedom of movement only in the plane parallel to the base of connector mount 102, as illustrated in FIG. 7A.

Figure 7B:
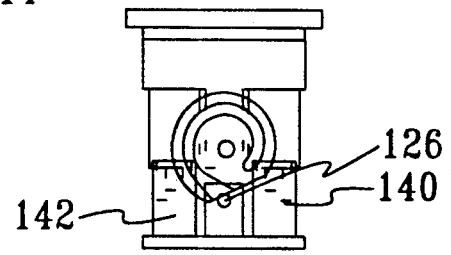
FIG. 7B is a side orthogonal view of parallel latching device 100 in the initially engaged position.

FIG. 7B illustrates the parallel latching device 100 in its initially engaged position. As the top section 102 and bottom section 104 are drawn together, male connector housings 130 and 132 may laterally adjust in the indicated float plane in order to initially align with the female connector housings 140 and 142. Simultaneously, lock and eject cam 106 aligns with catch pin 126 on the lock and eject catch 114.

The lock and eject cams 106 and 108 guarantee that the connector mount 102 and the lock and eject catch 114 approach each other in a parallel fashion. This in turn guarantees that the male connector housings 130 and 132 and female connector housings 140 and 142 connect in a parallel fashion. In the initial engagement position of FIG. 7B, the lock and eject cams 106 and 108 have not moved from their stationary positions.

Figure 7C:
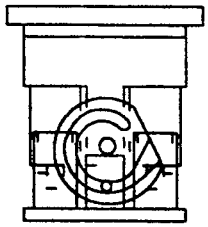
FIG. 7C is a side orthogonal view of parallel latching device 100 in the engaged position.

FIG. 7C illustrates the parallel latching device 100 in its engaged position. The engaged position is established when catch pin 126 passes through the lock and eject cam slot 110 and enters the lock and eject cam channel 158. Lock and eject cam 106 has been rotated slightly such that the catch pin 126 has partially traveled the total distance of the lock and eject cam channel 158. As the catch pin 126 travels along the lock and eject cam channel 158, the male connectors 130 and 132 have traveled further into female connectors 140 and 142.

Figure 7D:
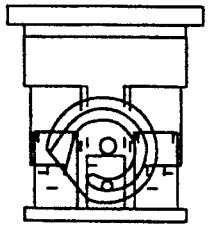
FIG. 7D is a side orthogonal view of parallel latching device 100 in the fully engaged position.

FIG. 7D illustrates the parallel latching device 100 in its fully engaged or latched position. This position is achieved when the lock and eject catch mating surface 152 comes into contact with the connector mount mating surface 150. These two surfaces come into contact at a point early enough to prevent damage to the connectors or the electrical terminals. An alternative method to limit the amount of travel of the connector housings is to place a physical stop along the lock and eject cam channel.

Every application utilizing parallel latching device 100 will require the present invention to satisfy one or more criteria. Examples of such criteria are the stroke, torque, clamping distance, clamping force, and engagement rate. The stroke is the vertical distance that a given pair of connector housings will travel once initial contact is made. In the present invention, stroke is defined as the vertical distance that lock and eject catch 114 will travel from the point at which the lock and eject cams 106 and 108 have to be rotated to pull the lock and eject catch 114 into its secured position. As described in reference FIGS. 7A-7D, lock and eject cams 106 and 108 are rotated out of their stationary position after the catch pins 126 and 128 are inserted into the lock and eject cam slots 110 and 112, respectively.

Torque is the amount of rotational force which must be applied to the lock and eject cams 106 and 108 to mate the connector housing. The clamping rotation is the rotational distance that the lock and eject cams 106 and 108 have to rotate before the parallel latching device 100 is in a fully engaged position. Clamping force is the amount of force the parallel latching device can apply to mate the connector housings. Engagement rate is the speed at which the connector housings approach each other for a given clamping rotation.

The lock and eject cams 106 and 108 of the present invention may be designed to accommodate these criteria dictated by a specific application. These criteria are satisfied by controlling three characteristics of the lock and eject cam. These are (1) the size of the lock and eject cam, (2) the length of the lock and eject cam channel, and (3) the ramp angle of the lock and eject cam channel. Each of these are discussed below.

Figure 8:
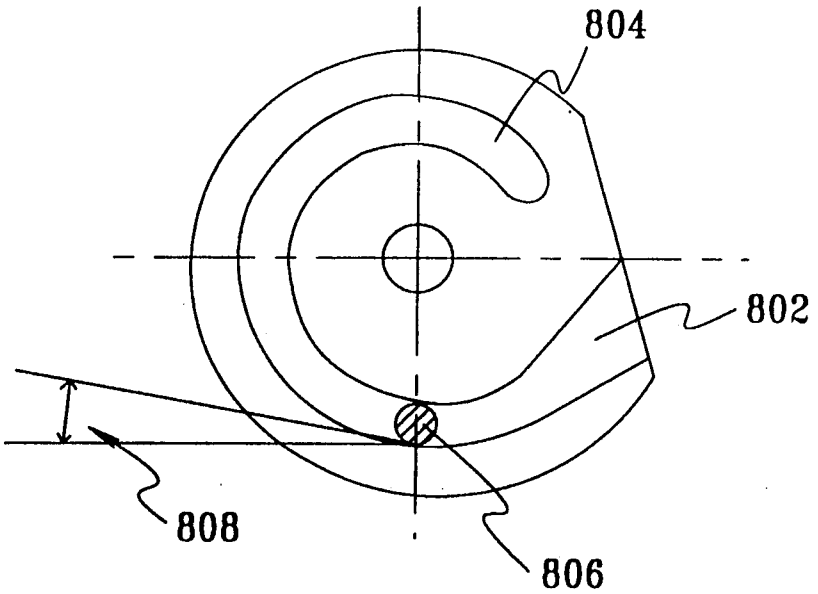
FIG. 8 is an orthogonal view of lock and eject cam 800.

Referring to FIG. 8, lock and eject cam 800 is illustrated. As discussed above, the lock and eject cam 800 is comprised of a lock and eject cam slot 802 which provides entry into the lock and eject channel 804 for the catch pin 806.

The first characteristic, lock and eject cam size, may be varied within the confines of the physical space in a specific application. The size of the lock and eject cam 800 determines the amount of stroke. A small lock and eject cam will result in a small stroke while a larger lock and eject cam will result in a proportionally larger stroke. In the preferred embodiment of the present invention, the required stroke was 0.15 inches and the diameter of lock and eject cam 800 is approximately 0.90 inches. The second characteristic, lock and eject cam channel length, determines the clamping rotation. The greater the length of the lock and eject cam channel 804, the greater the clamping rotation (distance in degrees of rotation).

The third and most important characteristic, ramp angle, determines the torque, clamping force, and engagement rate. The ramp angle 808 is illustrated in FIG. 8. Ramp angle 808 is defined as the inverse tangent of the change in radius divided by the arc length traveled.

Figure 9C:
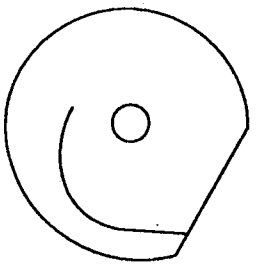
FIGS. 9A–9C illustrate various lock and eject cam channel profiles of the present invention.
Figure 9B:
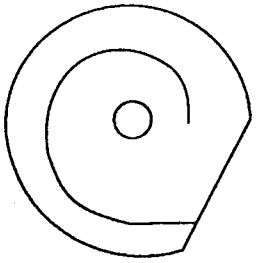
Figure 9A:
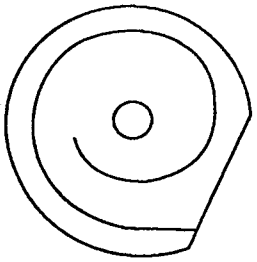

By changing these three characteristics of the lock and eject cam 800, a completely customized connection can be acquired. Three examples, one of which is the cam profile of the preferred embodiment, are given below. For clarity, the same stroke is used for all three examples so that the size of the cams remain constant. Referring to FIGS. 9A-9C and Table 1 below, three cam profiles are illustrated. The cam profile used in the preferred embodiment of the present invention is illustrated in FIG. 9B.

Figure 10:
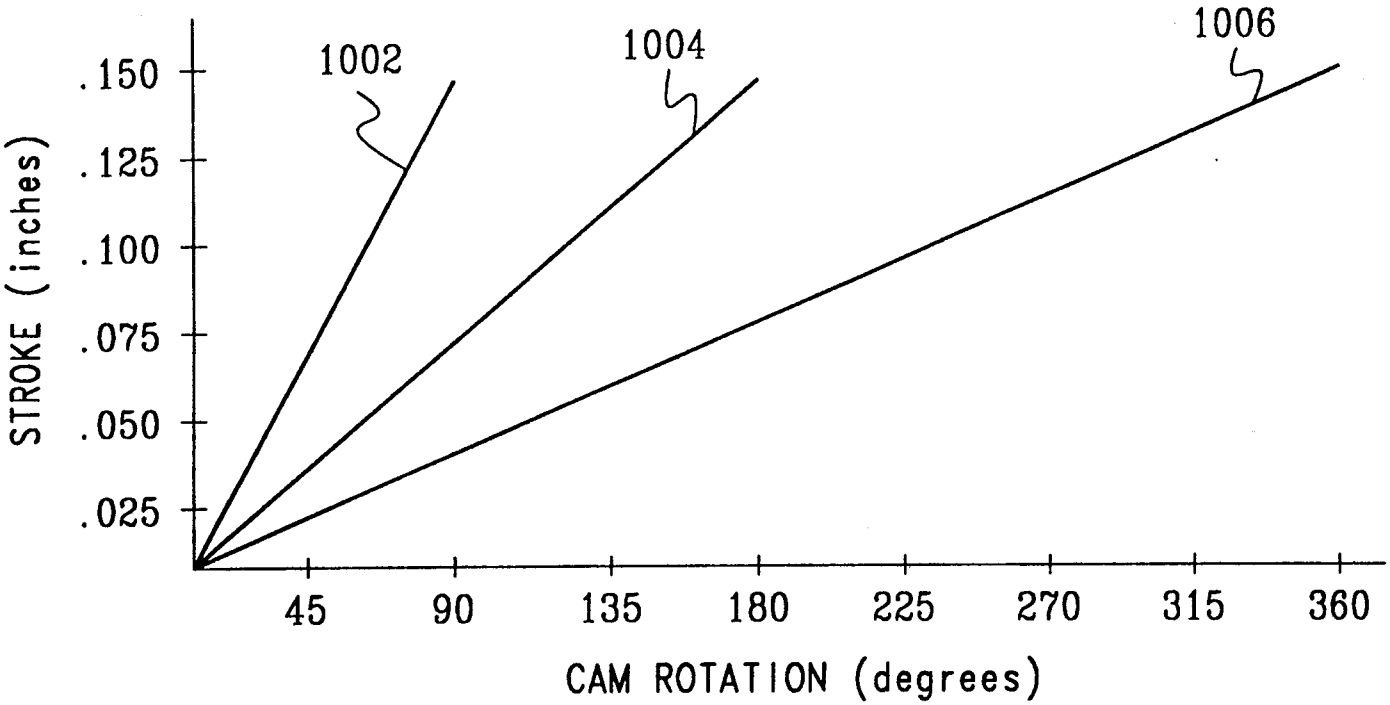
FIG. 10 is a graph illustrating the stroke achieved for a given cam rotation for the lock and eject cam channel profiles illustrated in FIGS. 9A–9C.

By comparing the cam profiles in FIGS. 9A-9C with the data in Table 1 and the graph in FIG. 10, one can see the relationship between the ramp angle and the clamping rotation, torque, engagement rate,and clamping force. As the ramp angle increases, the torque, and engagement rate increase proportionally. However, the clamping force and distance are inversely proportional to the ramp angle, i.e., as the ramp angle is increased, the amount of clamping force and distance are proportionally decreased.

TABLE 1

Lock and Eject Cam Profiles for a Given Inch Stroke (Values Are Approximate)

| Design Criteria | Figure 9A | Figure 9B | Figure 9C |
|---|---|---|---|
| Ramp Angle (degrees) | 7.5 | 15 | 30 |
| Clamping Distance (degrees of rotation) | 360 | 180 | 90 |
| Clamping Force | High | Medium | Low |
| Torque (inch lbs.) | 2 | 4 | 8 |
| Engagement Rate | Low | Medium | High |

These relationships are further illustrated in reference to FIG. 10 whereby the stroke achieved for a given cam rotation is depicted. The three lines in FIG. 10 graphically represent the three cam profiles illustrated in FIGS. 9A-9C. Line 1002 represents the cam profile of FIG. 9C; 1004, 9B; and 1006, 9A. The cam profiles decrease from the highest ramp angle in FIG. 9C and line 1002 to the lowest in FIG. 9A and 1006. A larger ramp angle requires a smaller cam rotation to achieve a given stroke as illustrated in FIG. 10. Line 1002 achieves the 0.15 inch stroke at 90 degrees of cam rotation; 1004 at 180 degrees; and 1006 at 360 degrees. The difference in slope of these three lines is also indicative of the associated engagement rate. The greater slope (higher ramp angle), the faster a given stroke is achieved.

The difference is slopes of lines 1002, 1004, and 1006 are also indicative of the amount of torque and clamping force of the associated cam profile.. The torque required to achieve a 0.15 inch stroke in only 90 degrees of rotation is greater than the torque required to achieve the same rotation in 360 degrees. Given this low torque requirement, the lower ramp angle can support a high clamping force application.

Figure 11:
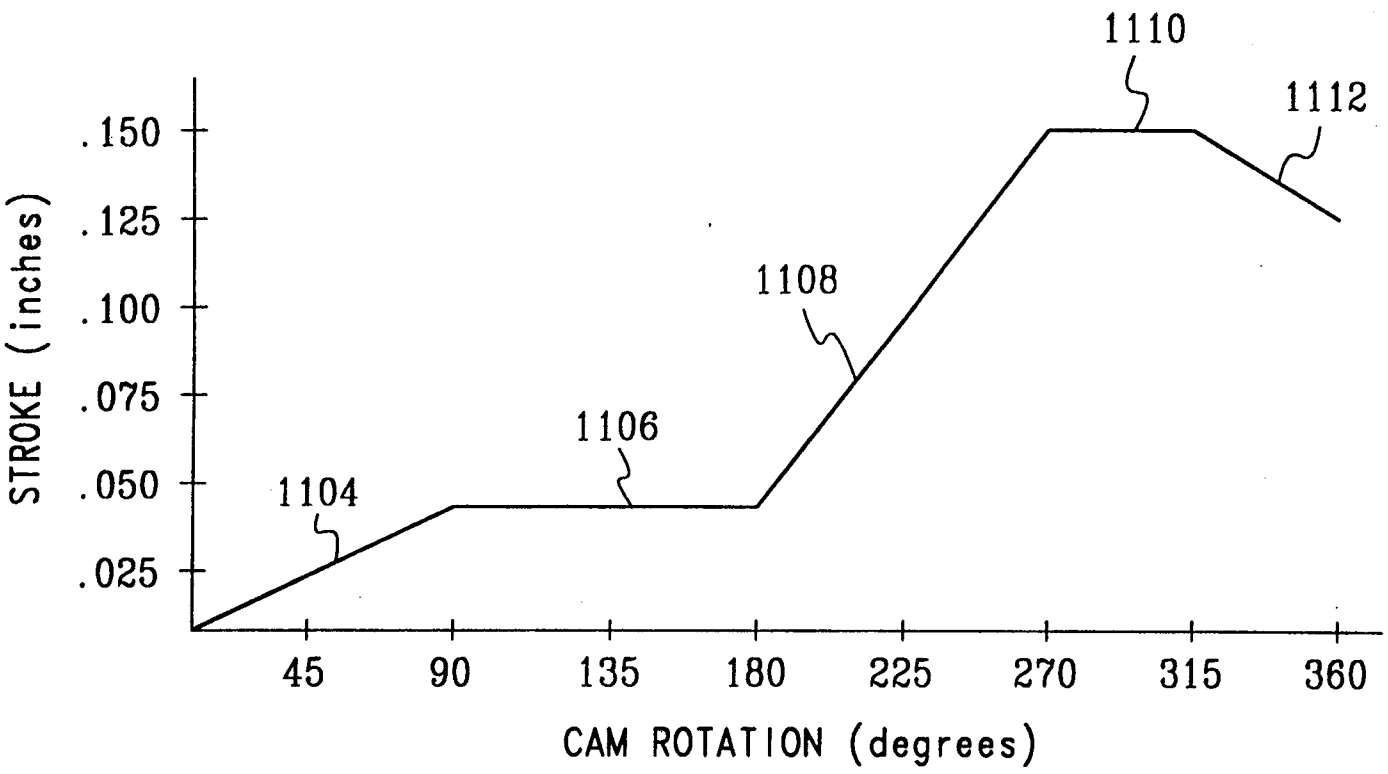
FIG. 11 is a graph illustrating the stroke achieved for a given cam rotation for the cam channel profile illustrated in FIG. 12.
Figure 12:
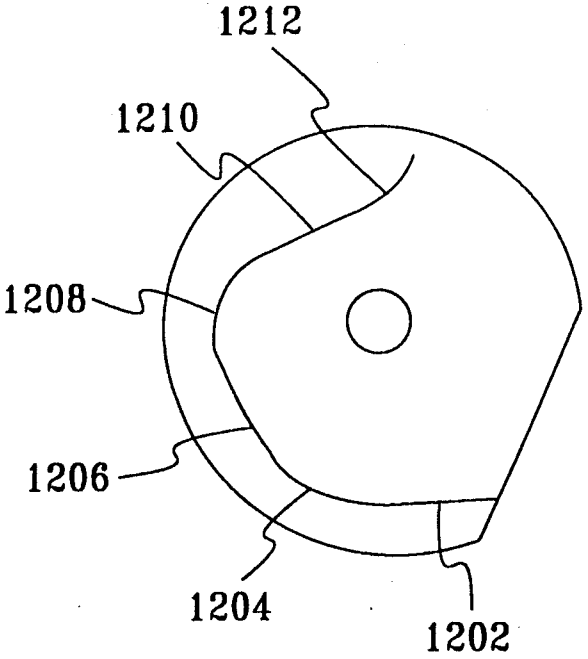
FIG. 12 illustrates a lock and eject cam channel profile which relaxes cam loading after full engagement is achieved.

Referring to FIGS. 11 and 12, a five segment cam profile is illustrated. The graph segments shown in FIG. 11 represent associated cam profile sections in FIG. 12 having the same last two digits in the reference number. Cam profile section 1202 is the cam access slot which yields access to the cam channel, and is not illustrated in FIG. 11.

Segment 1104 represents cam profile section 1204 having a ramp angle of 7.5 degrees, similar to cam profile discussed in reference to FIG. 9A. Segment 1108 represents can profile section 1208 having a ramp angle of 30 degrees, similar to cam profile discussed in reference to FIG. 9C.

Segments 1106 and 1110 are parallel with the can rotation axis. There is no increase or decrease in stroke as the catch pin travels along sections 1206 and 1210 of the cam profile of FIG. 12. In other words, the clamping operation is paused while the lock and eject cam is rotated.

The last segment, segment 1112, has a negative slope indicative of a cam profile which actually relaxes the clamp load and the cam is rotated. That is, the stroke actually decreases rather than increases. A design such as this may be used in applications where, once the terminals of the mating connectors are completely and securely connected, there is a need to remove the compression force from the terminals.

Given these examples, as one of ordinary skill in the art will realize, the present invention may be applied to virtually any connection application by selecting the cam channel profile, the materials, and size of the parallel latching device components.

While the invention has been particularly shown and described with reference to preferred embodiments thereof, it will be understood by those skilled in the art that various changes in form and detail may be made therein without departing from the spirit and scope of the invention.

What is claimed is:

1. A latching device for connecting a first mating component to a second mating component along a first axis, comprising:

a connector mount configured to be attached to the first mating component;

a torsion bar channel extending through said connector mount along a second axis, wherein said second axis is substantially perpendicular to the first axis;

a torsion bar, having a first end and a second end, extending through said torsion bar channel;

a lock and eject catch member configured to be attached to the second mating component;

a first catch pin extending out from said lock and eject catch member along a third axis, wherein said third axis is substantially parallel to said second axis;

a second catch pin extending from said lock and eject catch member along said third axis in a direction opposite said first catch pin;

a first cam member fixedly coupled to a first end of said torsion bar, said first cam member providing a first cam channel configured to mate with said first catch pin and to provide a cam action along the first axis when the first and second mating components are brought together and said first cam member is rotated; and a second cam fixedly coupled to a second end of said torsion bar, said second cam member providing a second cam channel configured to mate with said second catch pin and to provide a cam action along the first axis when the first and second mating components are brought together and said second cam member is rotated;

wherein said first and second cam channels have substantially similar paths so that rotation of either cam will cause a smooth mating of the first and second mating components along the first axis and wherein a rotational force applied to said first cam member is transferred to said second cam member through said torsion bar and a rotational force applied to said second cam member is transferred to said first cam member through said torsion bar, said rotational force causing said first and second cam members to rotate through any number of rotations of part thereof.

2. The latching device of claim 1, further comprising:

a guide member connected to and extending from said connector mount along the first axis; and a guide receiving channel within said lock and eject catch member, said guide receiving channel configured to receive said guide member of said connector mount;

wherein aligning said guide member with said guide receiving channel causes said first catch pin to be aligned with said first cam channel and said second catch pin to be aligned with said second cam channel.

3. The latching device of claim 1, further comprising:

a first connector housing connected to the first mating component;

a second connector housing connected to the second mating component; and securing means for preventing the overcompression of said first and second connector housings, and for maintaining said first connector housing parallel to said second connector housing when said first connector housing is connected to said second connector housing.

4. The latching device of claim 3, wherein said securing means comprises:

a first mating contact surface on said connector mount substantially parallel with said second axis; and a second mating contact surface on said lock and eject catch member substantially parallel with said third axis, wherein said first mating contact surface contacts said second mating contact surface when said first and second mating components are fully connected.

5. The latching device of claim 4, further comprising a friction means, coupled to said torsion bar and said first and second cam members, for preventing unassisted rotation of said first and second cam members.

6. The latching device of claim 5, wherein said friction means is a wave spring surrounding said torsion bar.

7. The latching device of claim 5, further comprising a cam rotating knob attached to one of said first cam member and said second cam member.

8. The latching device of claim 7, further comprising a cam securing means for fixedly coupling said torsion bar to said first and second cam means.

9. The latching device of claim 8, wherein said cam securing means comprises:

a flanged head on one of said first end and second end of said torsion bar; and a locking inset on one of said first and second cam members, said locking inset configured to lockingly accept said flanged head.

10. An electrical connector for connecting components along a first axis, comprising:

a connector mount;

a first connector, coupled to said connector mount, having at least one first electrical contact;

a torsion bar channel extending through said connector mount along a second axis, wherein said second axis is substantially perpendicular to the first axis;

a torsion bar extending through said torsion bar channel;

a lock and eject catch member;

a first catch pin connected to and extending from a first side of said lock and eject catch member along a third axis, wherein said third axis is substantially parallel to said second axis;

a second catch pin connected to and extending from a second side of said lock and eject catch member along said third axis in a direction opposite said first catch pin;

a second connector, coupled to said lock and eject catch member, having at least one second electrical contact, said second connector configured to mate with said first connector and cause an electrical connection between said at least one first electrical contact and said at least one second electrical contact;

a first cam member fixedly coupled to a first end of said torsion bar, said first cam member providing a first cam channel configured to mate with said first catch pin and to provide a cam action along the first axis when the first and second connectors are brought together and said first cam member is rotated;

a second cam member fixedly coupled to a second end of said torsion bar, said second cam member providing a second cam channel configured to mate with said second catch pin and to provide a cam action along the first axis when said first and second connectors are brought together and said second cam member is rotated;

wherein said first and second cam channels have substantially similar paths so that rotation of either cam will cause a smooth mating of the first and second connectors along the first axis and wherein a rotational force applied to said first cam member is transferred to said second cam member trough said torsion bar and a rotational force applied to said second cam member is transferred to said first cam member through said torsion bar, said rotational force causing said first and second cam members to rotate through any number of rotations or part thereof.

11. The latching device of claim 10, wherein said connector mount further comprising a guide member connected to and extending from said connector mount along an axis substantially parallel with said first axis, and wherein said lock and eject catch member further includes a guide receiving channel configured to receive said guide member of said connector mount;

wherein aligning said guide member with said guide receiving channel causes said first catch pin to be aligned with said first cam channel and said second catch pin to be aligned with said second cam channel and said first connector to be aligned with said second connector.

12. The latching device of claim 11, wherein said securing means comprises:

a first mating contact surface on said connector mount substantially parallel with said second axis adjacent to said guide member;

a second mating contact surface on said lock and eject catch member substantially parallel with said third axis adjacent to said guide receiving channel; and said first and second connectors being fixedly coupled to said connector mount and said lock and eject catch member, respectively, such that said first and second mating contact surfaces meet when said second connector has mated with said first connector and said electrical connection between said first electrical contact and said second electrical contact has been established.

13. The latching device of claim 12, further comprising a friction means for preventing unassisted rotation of said first cam and said second cam.

14. The latching device of claim 13, wherein said friction means is a wave spring, said wave spring configured to surround said torsion bar.

* * * * *